United States Patent [19]

Giammattei

[11] 4,029,067

[45] June 14, 1977

[54] FUEL INDUCTION SYSTEM FOR INTERNAL COMBUSTION ENGINE

[76] Inventor: Guy Giammattei, 1523 Chapel St., New Haven, Conn. 06511

[22] Filed: Mar. 29, 1976

[21] Appl. No.: 671,168

[52] U.S. Cl. ..... 123/136

[51] Int. Cl.[2] ..... F02M 59/00

[58] Field of Search ..... 123/198 R, 198 C, 198 P, 123/136

[56] References Cited

UNITED STATES PATENTS

| | | | |
|---|---|---|---|
| 200,970 | 3/1878 | Brady | 123/136 |
| 1,111,335 | 9/1914 | Walden | 123/136 |
| 1,488,254 | 3/1924 | Johnson | 123/198 R |
| 1,988,797 | 1/1935 | Hueber | 123/136 |
| 2,794,431 | 6/1957 | Ginnow | 123/136 |
| 3,022,053 | 2/1962 | Hoyt | 123/136 |

*Primary Examiner*—Ronald B. Cox

*Attorney, Agent, or Firm*—Arthur T. Fattibene

[57] ABSTRACT

A fuel induction system for use with an internal combustion engine which includes an air pump or a source of compressed air to pressurize a fuel tank whereby the build up of pressure within the tank is utilized to feed fuel to an internal combustion engine in the event of a malfunction of the fuel pump and/or to prime the engine.

5 Claims, 2 Drawing Figures

FUEL INDUCTION SYSTEM FOR INTERNAL COMBUSTION ENGINE

PROBLEM

The fuel injuction system for present day internal combustion engines includes a fuel pump for feeding fuel from the fuel tank to a carborator or engine. In the event the fuel pump should malfunction, the fuel flow to the carborator or engine ceases, thereby rendering the engine useless until the fuel pump can be repaired and/or replaced. Should the fuel pump fail or malfunction while a vehicle is being driven, the vehicle is rendered inoperative, and frequently, must be abandoned or towed to the nearest repair station. Failure of the fuel pump under such circumstances causes serious inconvenience and/or expense. Such failure can also cause serious hazzards and/or dangers, e.g., in the case of a woman driver becoming stranded on a dark and lonely road.

It also happens that many motorists frequently run out of gas. When this occurs a vapor lock frequently occurs in the fuel system which prevents the restarting of the engine after sufficient fuel has been attained. In such instances, it becomes necessary to manually prime the engine with fuel. This is attained by pouring fuel directly into the carborator or cylinders. The priming of engines in this manner can be a hazzard and is dangerous.

Also it frequently happens that a fuel system may develop a leak which may be undetectable when the engine is not running. In such cases fuel is not only wasted, but there is also present a serious fire hazzard if such leak goes unnoticed.

Starting in cold or sub-zero weather is frequently a problem because difficulty of getting proper fuel flow to the engine.

OBJECTS

An object of this invention is to provide a fuel induction system in which the fuel flow to a carborator engine can be maintained even though the fuel pump utilized in such system is rendered inoperative and/or malfunctioning.

Another object is to provide a fuel induction system which enables fuel to penetrate to an engine without the need of priming the engine to effect a restarting thereof after having run out of fuel and/or during cold weather starting.

Another object is to provide a fuel induction system in which the fuel lines can be periodically tested for leaks.

Another object is to provide a fuel induction system in which a back-up is provided for pumping fuel to the engine in the event of a fuel pump failure.

Another object is to provide for pressurizing a fuel tank to effect positive fuel flow to an engine.

Another object is to provide a fuel induction system which can be readily checked for fuel leaks.

BRIEF SUMMARY OF INVENTION

The foregoing objects and other features and advantages are attained by incorporating into a fuel induction system, e.g., of an automobile or vehicle, a source for producing a fluid pressure and imposing such fluid pressure on the fuel tank of the vehicle whereby fuel flow to the engine or carborator can be maintained by such pressure. The arrangement is such that should the conventional fuel pump malfunction, and fuel cannot be fed to the engine, fuel flow can be maintained by pumping compressed air into the fuel tank. This attained in one embodiment by an air pump, the outlet of which is connected by means of an air line to the fuel tank. Whenever the fuel pump malfunctions or fails to pump fuel to the engine, the air pump is actuated to pressurize the tank.

In another embodiment the fuel tank can be pressurized by utilizing the compressed air stored in an inflated tire, e.g., the spare tire of a vehicle.

IN THE DRAWINGS

DETAILED DESCRIPTION

Figures 1, 2:
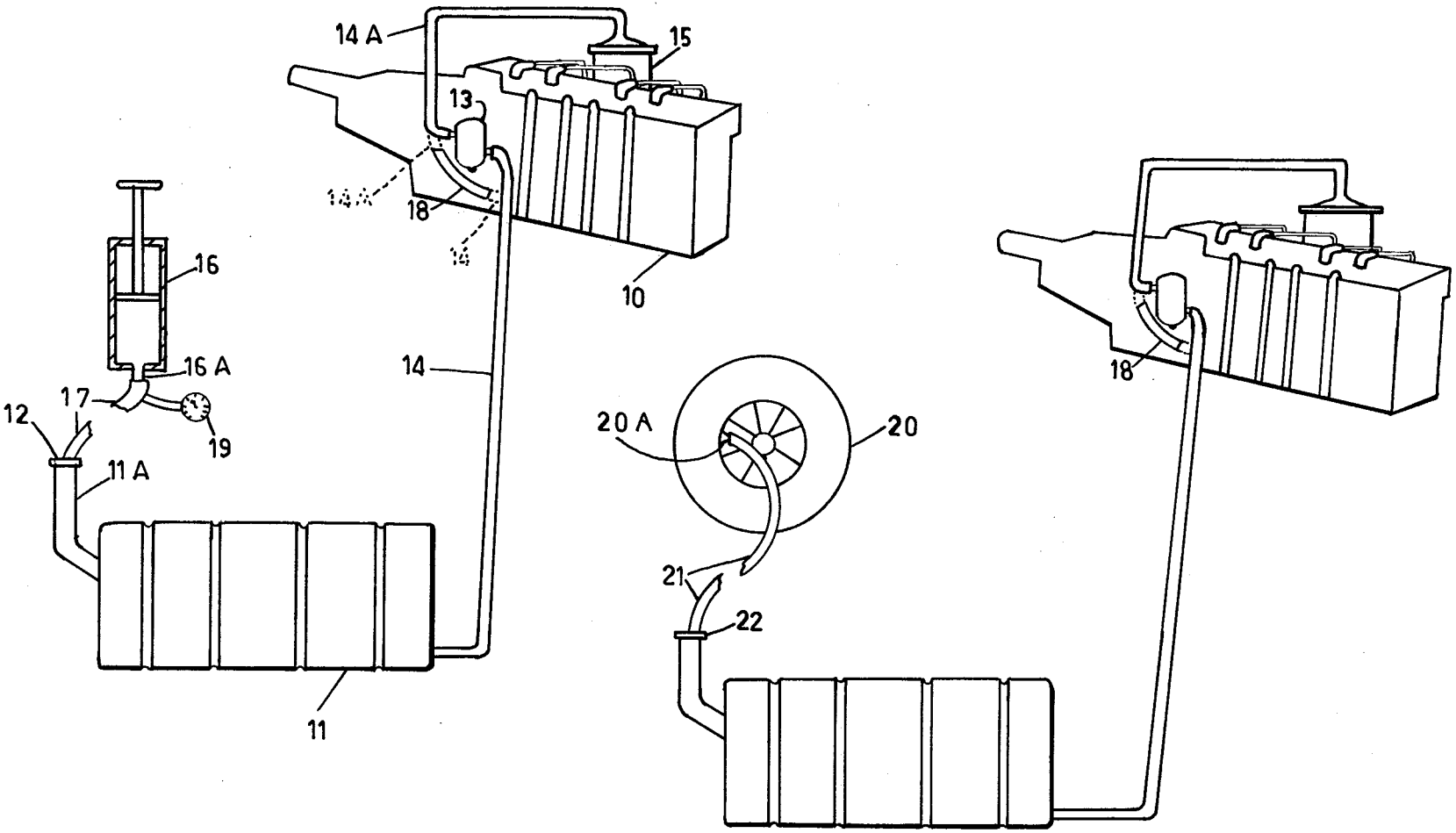
FIG. 1 illustrates a fuel induction system in diagrammatic form which embodies the present invention.
FIG. 2 is a modified embodiment.

Referring to FIG. 1 there is shown therein a fuel induction system which can be utilized in any type of vehicle, e.g., an automobile, boat, airplane and/or any fuel driven appliance operated by an internal cumbustion engine. As shown the system includes an internal cumbustion engine 10 which is supplied with fuel, e.g., gasoline stored in a fuel tank 11. The fuel tank includes a fuel inlet 11A which is generally closed by a fuel cap 12.

A fuel pump 13 operative associated with the engine is interposed in the fuel line 14, 14A for normally pumping the fuel from the tank 11 to the carborator 15 where the fuel is mixed with air to form a fuel mixture which is fed to the cylinders of the engine 10 in the usual manner.

In accordance with this invention, there is provided a source of fluid pressure for pressurizing the fuel tank, should the fuel pump 13 malfunction. As shown in FIG. 1, the fluid pressure source comprises an air pump 16 which is illustrates a piston pump which can be manually operated. When used in a vehicle the air pump may be located near the driver's seat where it can be readily operated when needed.

The outlet 16A of the air pump is connected to an air line 17. The other end of the air line 17 connects through the fuel cap 12 to the interior of the fuel tank.

In operation should the fuel pump 13 malfunction, and/or fuel is prevented from being fed to the carborator, fuel flow can be maintained by pressurizing the fuel tank. This is attained simply by actuating the air pump which results in increasing the pressure within the fuel tank. When the pressure in the fuel tank has been built up to a predetermined pressure, e.g., 10 to 20 lbs., the fuel therein will be forced to the carborator. To facilitate fuel flow, the fuel pump 13 can be by-passed by coupling a by-pass hose or conduit 18 between the outlet of line 14 and the inlet of line 14A. With the by-pass hose 18 in position as shown in FIG. 1, the build up of pressure within tank 11 will cause the fuel to flow to the carborator through lines 14, 18 and 14A.

With the system described it will be evident that a vehicle can be maintained operative even though the fuel pump should malfunction. Accordingly, the described system will obviate a cause which heretofore caused many motorists to be stranded because of fuel pump problems.

The system described is also useful for restarting an engine, should it run out of fuel. When adequate fuel has been placed in the tank, after it has run dry, the engine can be started by imposing a pressure on the tank. This pressure will force fuel into the carborator to effect the priming thereof.

The structure described will also facilitate starting of an engine during cold or sub-zero weather. In such cold weather, the fuel can be forced through the fuel pump by increasing the pressure within the fuel tank by means of air pump 16 as described. There the present invention provides a positive means by which fuel can be forced through the fuel pump to the carborator or engine.

Also should any leaks develop in the fuel system as described, the leaks can be readily detected by subjecting the tank to a positive pressure by actuation of the hand pump 16.

To appraise one of the amount of pressure imposed on the tank 11, there is disposed in the air line 17 a suitable pressure gage 19.

FIG. 2 illustrates a modified embodiment. This embodiment is similar to that described with respect to FIG. 1, except that the pressure fluid source comprises the compressed air contained in an inflated tire 20, e.g., the spare tire of a vehicle. As shown in FIG. 2, whenever the need arises to effect the fuel flow to the engine by pressure, an air line 21 is interconnected between the air valve 20A of the inflated tire 20 and the vent of the gas tank cap 22. In this manner the air pressure of the inflated tire is transferred to the tank interior whereby the build up of pressure within the tank will effect the fuel flow to the carborator.

From the foregoing it will be apparent that a simple and efficient system is provided to obviate the problems heretofore encountered because of defective and/or malfunctioning fuel pumps. Further, the results as described herein are attained with little or no change to the existing vehicle fuel supply systems.

While the invention has been described with respect to particular embodiments thereof, variations and modifications may be made without departing from the spirit or scope of the invention.

What is claimed is:

1. A fuel induction system for feeding fuel to an internal combustion engine comprising:

a fuel tank operatively connected to said engine, means for pressurizing said fuel tank to provide a positive pressure therein for feeding fuel to said engine, said means for pressurizing said fuel tank comprising a source of compressed air, wherein said source comprises an inflated tire.

2. In comintation with an internal combustion engine, a carborator operatively connected to said engine, a fuel tank connected to said carborator for supplying fuel thereto, and a fuel pump interconnected between said fuel tank and carborator, the improvement of a pressurizing means operatively connected to said gas tank for effecting the pressurization of said tank in the event the fuel pump malfunctions whereby the build up of a positive pressure within said tank effects the feeding of fuel to said carborator, and a conduit means interconnecting said fuel tank to said carborator whereby said conduit by-passes said fuel pump.

3. The invention as defined in claim 2 wherein said pressurizing means includes an air pump having an air outlet, a pump line connecting said air outlet in communication with said tank whereby the actuation of said air pump pressurizes said tank with a positive pressure to effect fuel flow to said carborator by by-passing said fuel pump.

4. In combination with an internal combustion engine, a carborator operatively connected to said engine, a fuel tank connected to said carborator for supplying fuel thereto.

and a fuel pump interconnected between said fuel tank and carborator, improvement of a pressurizing means operatively connected to said gas tank for effecting the pressurization of said tank in the event the fuel pump malfunctions whereby the build up of a positive pressure within said tank effects the feeding of fuel to said carborator, a conduit means interconnecting said fuel tank to said carborator whereby said conduit by-passes said fuel pump, said pressurizing means including an air pump having an air outlet, a pump line connecting said air outlet in communication with said tank whereby the actuation of said air pump pressurizes said tank with a positive pressure to effect fuel flow to said carborator by by-passing said fuel pump, wherein said fuel tank includes an inlet and a cap closing said inlet and said pump line having its other end disposed in communication with said tank through said cap.

5. In combination with an internal combustion engine, a carborator operatively connected to said engine, a fuel tank connected to said carborator for supplying fuel thereto, and a fuel pump interconnected between said fuel tank and said carborator, the improvement of a pressurizing means operatively connected to said gas tank for effecting the pressurization of said tank in the event the fuel pump malfunctions, whereby the build up of a positive pressure within said tank effects the feeding of fuel to said carborator, a conduit means interconnecting said fuel tank to said carborator whereby said conduit by-passes said fuel pump, and wherein said means includes an inflated tire having a valve stem, and a line interconnecting said valve stem to said tank whereby the pneumatic pressure of said tire is utilized to pressurize said tank.

* * * * *